US007350555B2

(12) United States Patent
Qing

(10) Patent No.: US 7,350,555 B2
(45) Date of Patent: Apr. 1, 2008

(54) STORM DOOR WITH A LIFT-UP LOCK CASE MORTISE AND METHOD OF USE

(75) Inventor: Wu Feng Qing, Chong Xing Town (CN)

(73) Assignee: Betteli, Inc. Hong Kong (HK)

( * ) Notice: Subject to any disclaimer, the term of this patent is extended or adjusted under 35 U.S.C. 154(b) by 293 days.

(21) Appl. No.: 10/957,269

(22) Filed: Oct. 1, 2004

(65) Prior Publication Data

US 2005/0099023 A1 May 12, 2005

Related U.S. Application Data

(60) Provisional application No. 60/508,154, filed on Oct. 2, 2003.

(51) Int. Cl.
*E05B 3/00* (2006.01)

(52) U.S. Cl. ..... 160/90; 160/369; 292/336.3; 70/107

(58) Field of Classification Search ..... 160/90, 160/113, 130, 181, 184, 369; 49/394, 463, 49/465, 460, 503, 72; 70/77, 91, 101, 107, 70/141; 16/65, 412; 292/336.3, 165, 163, 292/169, 169.14

See application file for complete search history.

(56) References Cited

U.S. PATENT DOCUMENTS

| | | | | |
|---|---|---|---|---|
| 1,589,496 | A * | 6/1926 | Whalbe | 292/336.3 |
| 6,174,005 | B1 * | 1/2001 | Norton | 292/169.21 |
| 6,282,929 | B1 * | 9/2001 | Eller et al. | 70/109 |
| 6,688,063 | B1 * | 2/2004 | Lee et al. | 52/455 |
| 2002/0100301 | A1 * | 8/2002 | Eller et al. | 70/224 |
| 2002/0113445 | A1 * | 8/2002 | Brown | 292/336.3 |

* cited by examiner

*Primary Examiner*—David Purol
(74) *Attorney, Agent, or Firm*—McKee, Voorhees & Sease, P.L.C.

(57) ABSTRACT

A storm door with a turn-away handle that does not obstruct normal manipulation of the storm door. The storm door permits seasonal changing between a screen or window and routine window cleaning without obstruction by an elongated handle. The storm door incorporates an actuator that has a hub with a free moving internal cam to permit moving an elongated handle from over an opening of the storm door to a position along the frame of the storm door. The method of use includes proving a storm door with a turn-away handle, moving it to a position that does not obstruct a window and screen, and moving it to a position that retracts a live bolt into the storm door.

10 Claims, 7 Drawing Sheets

STORM DOOR WITH A LIFT-UP LOCK CASE MORTISE AND METHOD OF USE

CROSS-REFERENCE TO RELATED APPLICATIONS

This application is a conversion of U.S. Provisional Application No. 60/508,154, filed Oct. 2, 2003, which is herein incorporated by reference in its entirety.

BACKGROUND OF THE INVENTION

1. Field of the Invention

The present invention generally relates to a storm door including a mortise lock and handle and more specifically to mortise lock for a storm door that includes a lift-up handle.

2. Prior Art

Storm door mortise locks typically have a live bolt that is activated by a door handle. During opening, the live bolt is retracted by the user turning the handle. During closing, the angular design of the live bolt and the force of the closing door cause it to retract upon contact with the strike plate on the door jam. The force of the closing storm door is typically sufficient to push the live bolt in until it passes by the first position of the strike plate and into the live bolt recess of the door jam.

Storm doors typically also have an internal latch mechanism that is actuated by turning a knob or handle. Such handle type latch mechanisms are particularly useful to a consumer because they are easily gripped and rotated. Handles are also often preferred by consumers who prefer the decorative style of a handle. However, handles have the disadvantage of extending beyond the door frame when at a right angle to the door frame (i.e. at a horizontal position to the door frame) and into the glass or screen section of the storm door. This creates difficulty in removing a storm door window or screen.

As is well known, storm door screens and windows are removed seasonally with the glass being in during the fall, winter and spring months when the weather is not conducive to permitting air into the house and the window replaced with a screen during the summer months to permit air into the house while preventing insects from entering the house. With such interchanging between a storm door screen and a storm door window, it is cumbersome to have a handle sticking into the plane of where the storm door window or screen is removed and inserted. Therefore, one objective of the present invention is to provide a storm door with a door handle which is moveable to a vertical position away from the storm door window such that easy access may be made for interchanging the storm door window and the storm door screen.

In addition, current storm door windows may also provide for screen and window sections to be included in the same door. In this style type of door, the window must be moved away from the screen to permit cleaning. With this style of window it is often desirable to have the window pivot from one side of the window outwardly. Most frequently, the window will pivot along a horizontal axis at the bottom of the window. Unfortunately, the prior art handles are not moveable into a vertical position and therefore the window does not fully extend but instead is obstructed by the handle which extends over the plane of the window. Therefore, another objective of the present invention is to provide a storm door with a handle which is tiltable to a vertical position such that the glass can be tilted from the window for easy cleaning.

In addition, some latch mechanisms rotate at a downward angle from horizontal for opening of the door. This rotating permits easier removal of the window or screen from the door frame; however, such rotation is typically not far enough to provide a meaningful clearance for the window or the screen to be removed from the door frame. In addition, handles on current storm doors are spring loaded such that they return to their default latched position. Therefore, a user who is trying to manipulate a screen storm door window or screen must maintain a grip upon the handle to achieve any additional clearance that may be available, thus defeating any benefit for manipulating the screen door out of the door frame because one hand must be maintained upon the handle. Therefore, a still further objective of the present invention is to provide a storm door that permits moving a door handle to a position that increases the clearance of the storm door window or storm door screen from the door frame and to maintain it in that position so that an individual may independently remove it from the door frame without maintaining contact with the handle or having a second consumer maintain the door handle in a second position.

A further objective of the present invention is the provision of a lift-up lock case mortise that is economical to manufacture and durable and safe in use.

The apparatus and method of accomplishing these and other features of the present invention will become apparent from the detailed description which follows.

SUMMARY OF THE INVENTION

Features of the Present Invention

A general feature of the present invention is the provision of a method and apparatus for providing a storm door with a mortise lock with a lift up handle which overcomes the problems found in the prior art.

One feature of the present invention is to provide a storm door with a door handle which is moveable to a vertical position away from the storm door window such that easy access may be made for interchanging the storm door window and the storm door screen.

Another feature of the present invention is to provide a storm door with a handle which is tiltable to a vertical position such that the glass can be tilted from the window for easy cleaning.

A still further feature of the present invention is to provide a storm door that permits moving a door handle to a position that increases the clearance of the storm door window or storm door screen from the door frame and to maintain it in that position so that an individual may independently remove it from the door frame without maintaining contact with the handle or having a second consumer maintain the door handle in a second position.

A further feature of the present invention is the provision of a method and apparatus for providing a storm door with a mortise lock in which the amount of door face may be maximized for insertion of a storm door window or storm door screen or the cleaning of a storm door window.

A still further feature of the present invention is the provision of a method and apparatus for providing a storm door with a lock handle which may be turned and moved in a fashion which will enable the user to instinctively move the handle out of the way while manipulating the storm door screen and storm door window.

A still further feature of the present invention is the provision of a lift-up mechanism that can be actuated by rotating the handle upward to a vertical position.

A further feature of the present invention is the provision of a lift-up lock case mortise that is economical to manufacture and durable and safe in use.

These, as well as other features of the present invention will become apparent from the following specification and figures.

SUMMARY OF THE INVENTION

The present invention generally comprises a storm door with a latch mechanism including a handle and a live bolt. The handle of the present invention is operatively connected to a spindle that is operatively connected to an exterior handle. Upon turning either of the handles, the nose is retracted or slid away from the catch secured to the interior wall or door jam and the door may be opened. Initially, the handle and the live bolt are rotatably secured to a linker. A spindle is inserted through a spindle cylinder. The spindle cylinder is in operative contact with the linker assembly and rotatably secured to the body of a storm door. The spindle cylinder allows the handle, linker and live bolt to be rotated, thereby causing the live bolt to swing away from the catch. A conventional turn-style handle can be operatively connected to the other end of the spindle in a conventional manner. In this way, the present invention provides a user a handle that may be turned to disengage the live bolt from the door jam, allowing the door to be opened.

The linker also has the ability to be rotated for the purpose of moving the handle from a horizontal position blocking a storm door window or screen to a vertical position where it is not blocking the storm door window and screen. In this way, the present invention provides the user with a handle that may be turned to move the door handle vertically but not disengage the live bolt from the door jam, thus allowing the window or screen to be moved without clearance problems from the door handle and with the door securely attached to the door jam.

These features, novelty and various other advantages that characterize the invention are pointed out with particularity in the specification and hereto. However, for better understanding of the invention, disadvantages, and objectives obtained by its use, reference should be made to the figures which form a further part hereof, and to accompanying descriptive matter, in which there is illustrated and described the preferred embodiment of the invention.

BRIEF DESCRIPTION OF THE DRAWINGS

Referring now to the drawings, wherein like reference numerals indicate corresponding structure throughout the several views.

DETAILED DESCRIPTION OF THE PREFERRED EMBODIMENT

Figure 1:
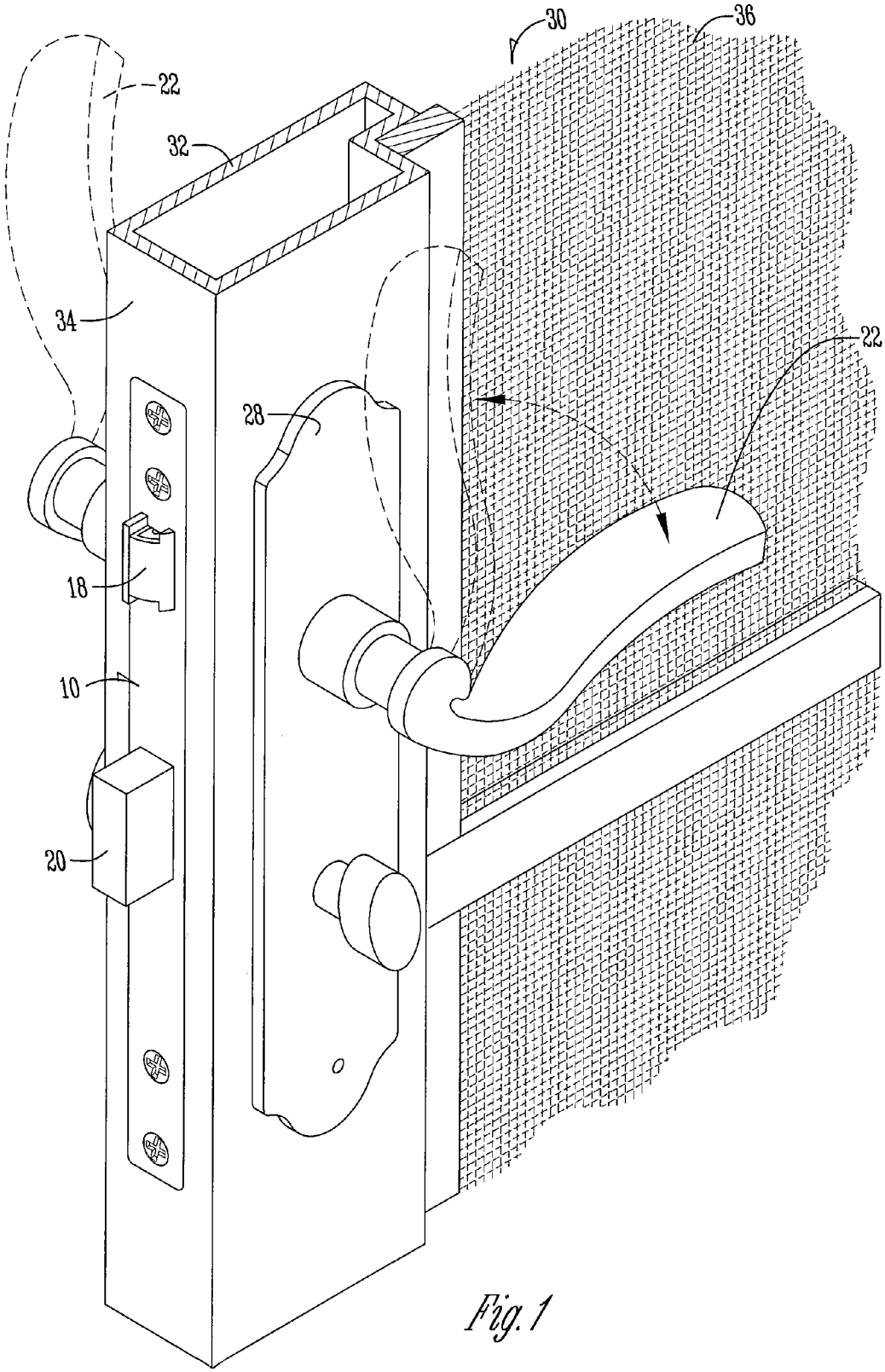
FIG. 1 is a perspective view of the handle in a horizontal position in use with a storm door and moveable to a vertical position.

The present invention will be described as it applies to its preferred embodiment. It is not intended that the present invention be limited to the described embodiment. It is intended that the invention cover all modifications and alternatives which may be included within the spirit and scope of the invention.

The lift-up lock case mortise is generally designated by the reference numeral 10 in the drawings.

Figure 2:
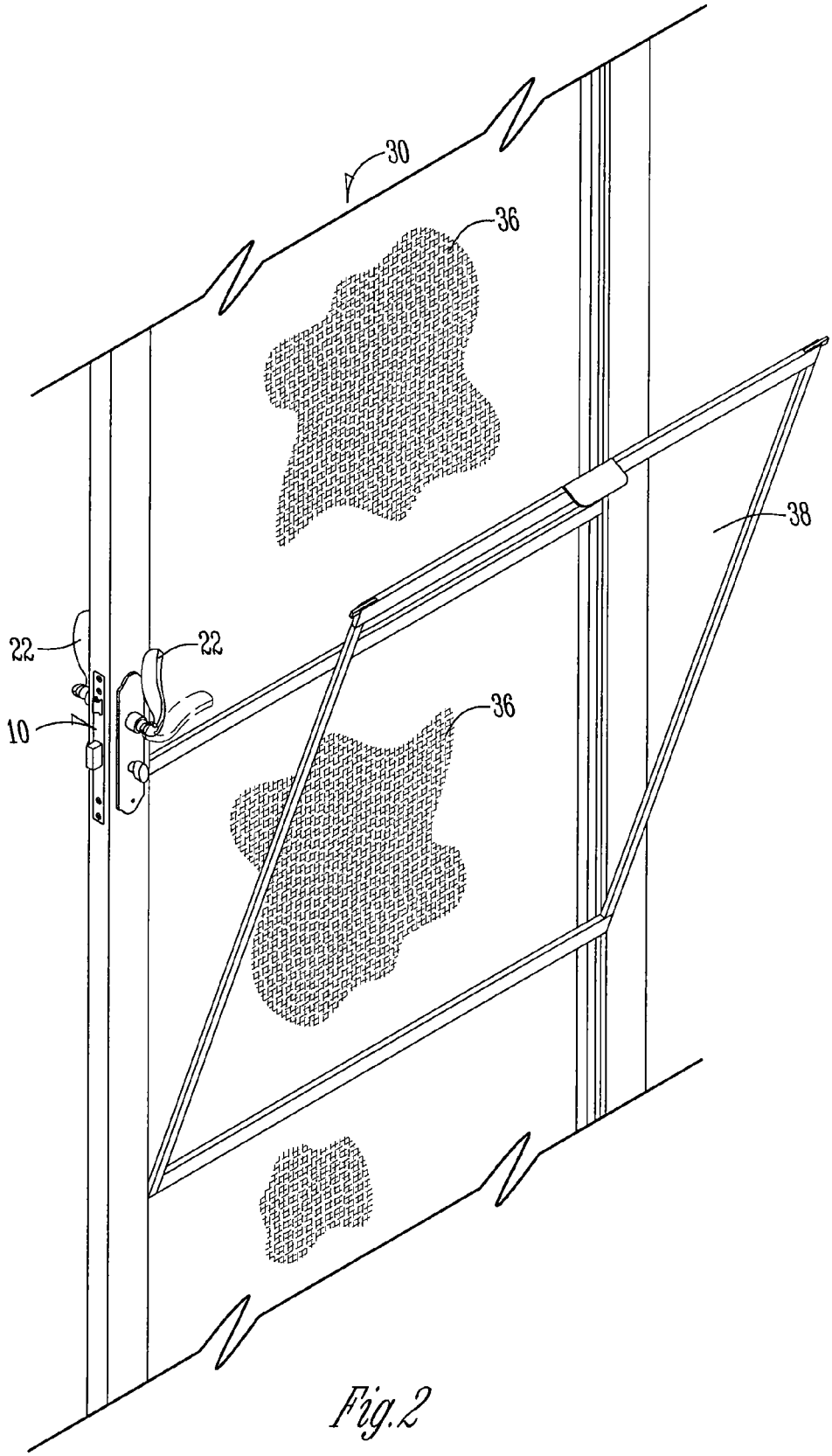
FIG. 2 is a perspective view of the handle in a lift-up position with the window away from the door and pivoting from the bottom to permit easy cleaning and/or removal.

As seen in FIGS. 1 and 2, the storm door 30 is a thin walled metal door with a door frame 32, a door edge 34, a screen 36 and/or a window 38. The handle 22 extends horizontally over the window 38 or screen 36 but pivots vertically to a stationary position. When the handle is vertical a window or screen may be removed and/or pivoted outward. An escutcheon plate 28 is provided for abutment to door 30.

Figure 3:
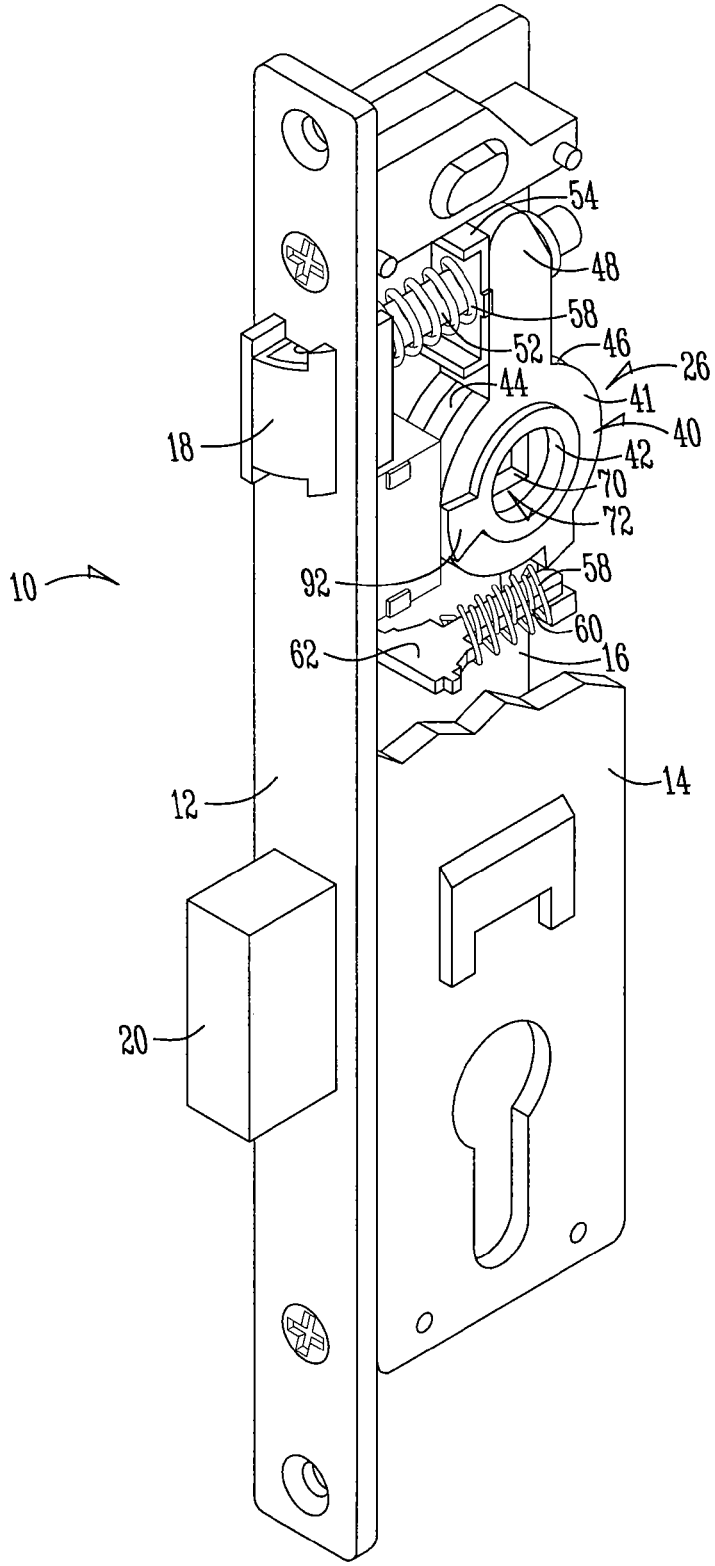
FIG. 3 is a perspective view of the lift-up lock case mortise exposing the latch mechanism of the present invention with the dead bolt in an engaged position.
Figure 4:
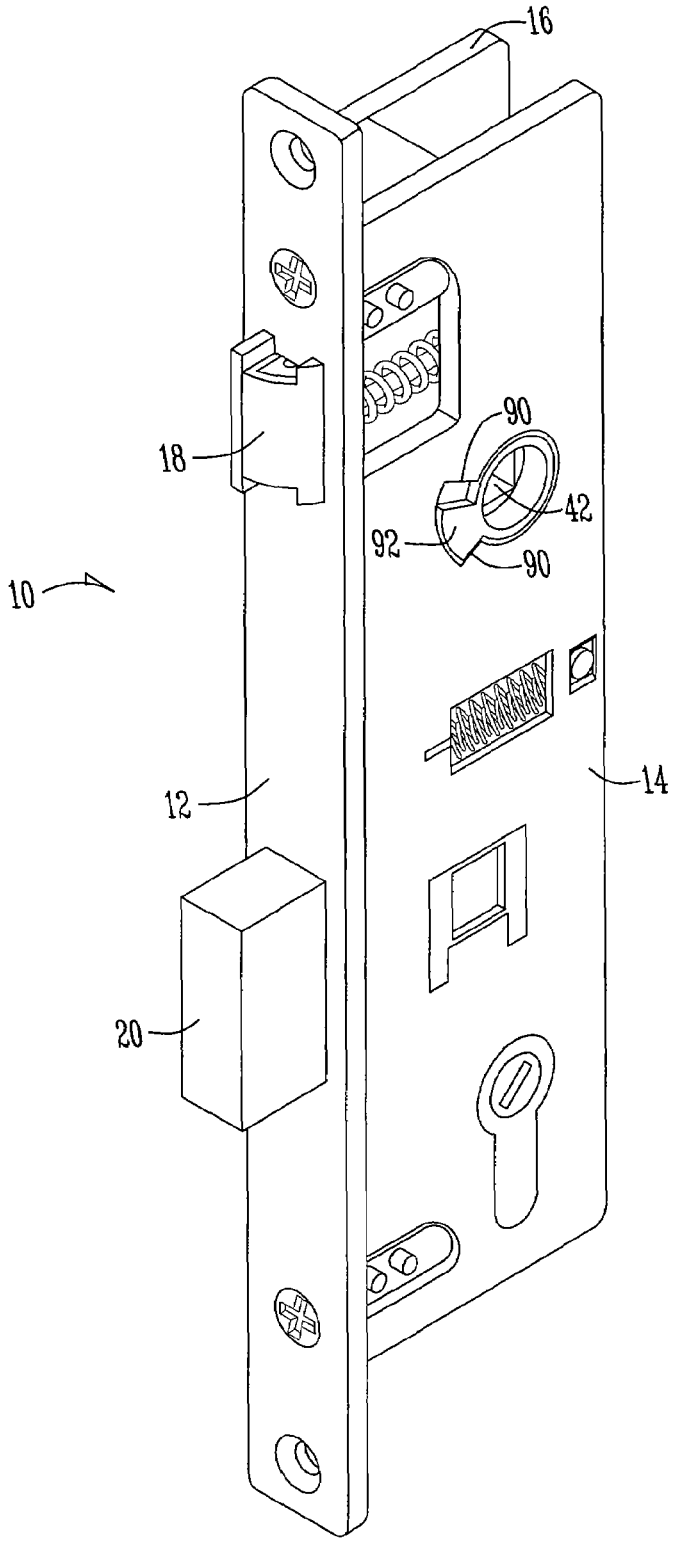
FIG. 4 is a perspective view of the lift-up lock case mortise with the latch mechanism enclosed and with the dead bolt in an engaged position.
Figure 5:
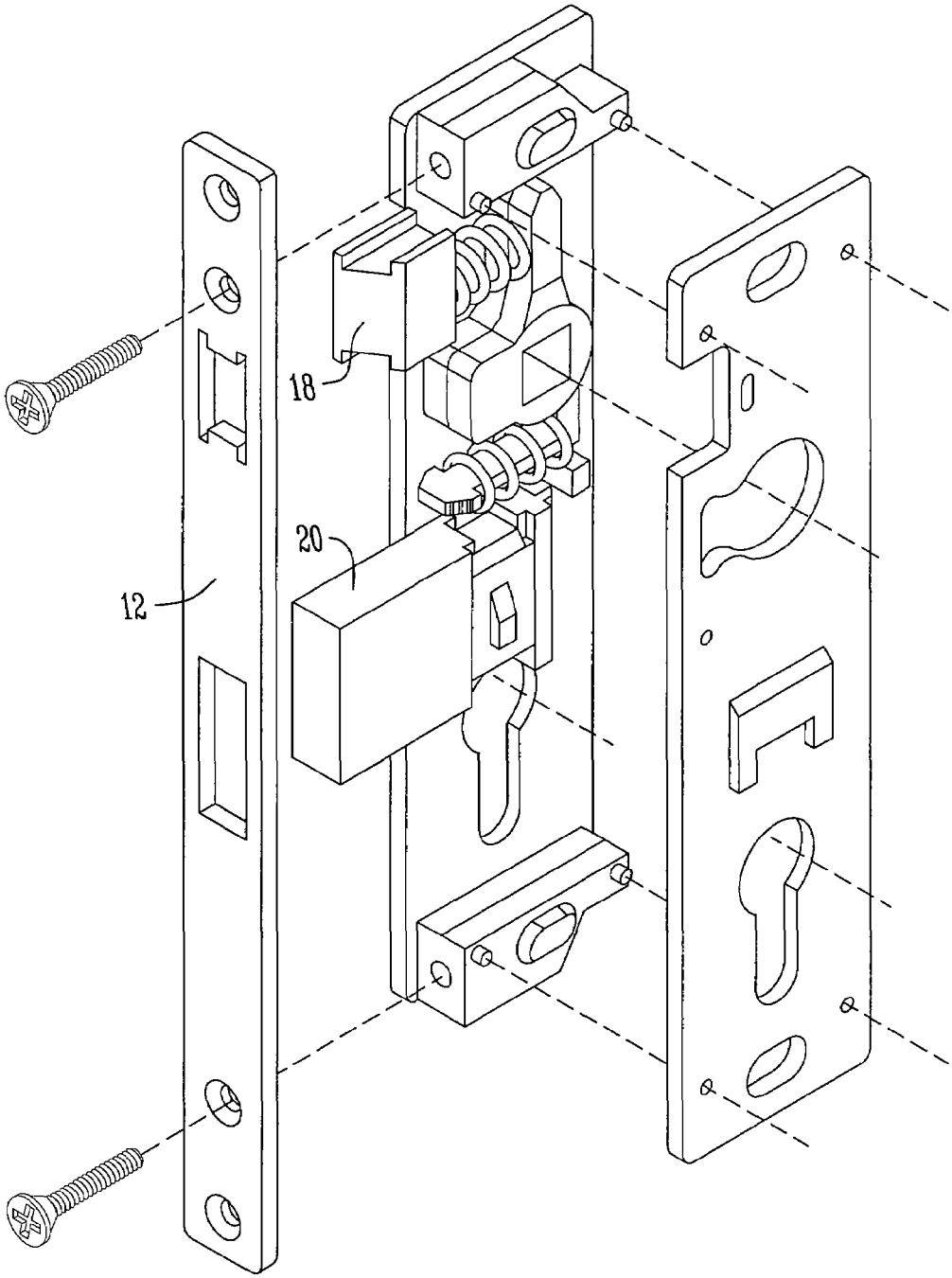
Fig.5 (PRIOR ART)
FIG. 5 is an exploded perspective view of the prior art lock case mortise exposing the latch mechanism and dead bolt mechanism.

As seen in FIGS. 3 and 4, the mortise latch 10 includes a trim plate 12 and first and second opposite side plates 14, 16. A live bolt 18 and a dead bolt 20 are intermediate the first and second side plates 14, 16. The bolts 18, 20 slide between retracted and extended positions beyond the trim plate 12. Opposed handles 22 have a spindle that extends through an actuator or linkage member 26.

The linkage assembly or actuator 26 has a hub 40 and an internal cam 70. The hub 40 has opposite faces 41, an internal chamber, a spindle receiving cavity 42, a first slot 44 in a first edge, and a second slot 46 in a second edge. Each slot defines a top surface 78 and a bottom surface 79. The hub 40 also has a top arm 48 attached to the live bolt 18 and a bottom arm 50.

The hub has a body 92 to prevent the handle from being turned more than approximately 40 degrees by engaging stops 90, and an internal cam permitting the handle to be lifted vertically.

The arm 48 engages the live bolt 18. The live bolt 18 is connected to the first arm 48 by having pin 52 attached to the first arm 48 by the bearing plate 54 and washer combination. A spring 53 is provided on the pin 52 so that the live bolt 18 may be pushed in past the trim plate 12 without action by the actuator 26.

The second arm 50 extends from the hub 40 and is used to exert force against springs 58 and 60 and a bearing plate 62 to exert force against the second arm 50 when the actuator is turned by the handle 22 to open the door such that when the handle 22 is released by the user the springs 58, 60 will push the lock live bolt 18 into the locked or engaged position.

Figure 6:
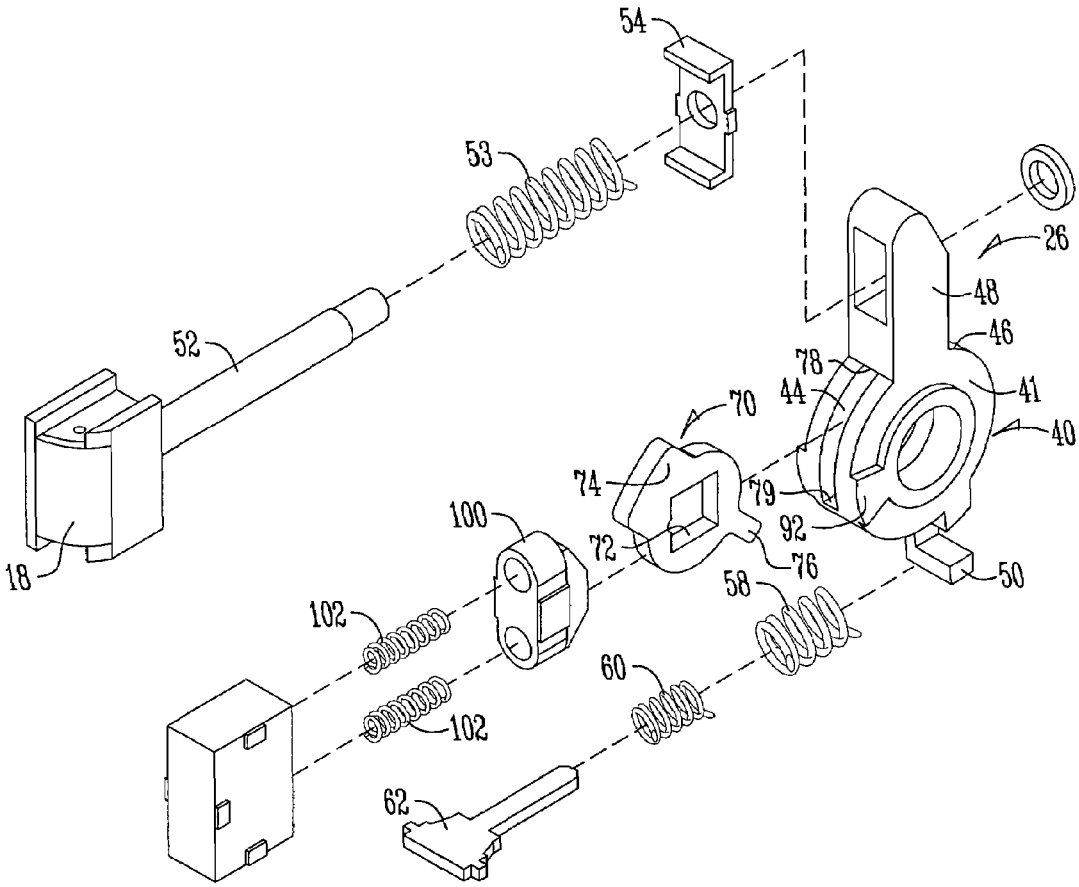
FIG. 6 is an exploded view of the linkage member and associated pieces that permit the handle to be lifted up.

As seen in FIG. 6, fitting within the hub 40 is a cam 70. The cam 70 has an opening 72 to receive the door spindle. The cam 70 is positioned within the hub 40 such that a first cam arm 74 is within the first hub slot 44 and a second cam arm 76 is within the second hub slot 46.

Figure 7A:
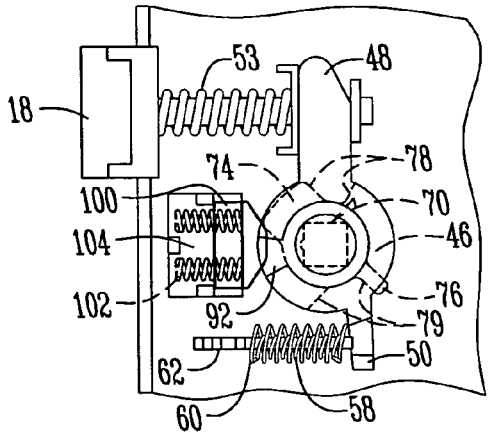
FIGS. 7A-C illustrates the linkage member and associated cam first in a normal position with the handle horizontal, second with the handle vertical, and third with the handle lowered to pull back the live bolt.
Figure 7B:
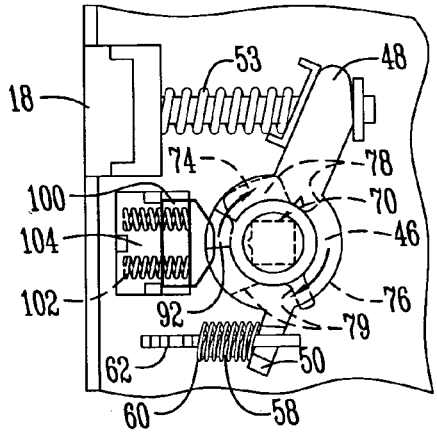

As seen in FIG. 7A, in operation the handle 22 is normally in the horizontal position. When the handle is in the horizontal position the second arm 76 of the cam rests against a bottom surface 79 of the second slot 46. From this position the handle can be turned clockwise, as seen in FIG. 7B, and the cam 70 would also turn clockwise such that the first arm 74 engages the first slot top surface 78 and the second arm 76 engages second slot bottom surface 79 thus turning actuator 26 clockwise. This clockwise action pulls the live bolt 18 into the storm door. The handle can only be turned approximately 40° because of stops 90 on the side plates 14, 16 engage a body 92 on the hub 40. When the user releases the handle the springs 58, 60 and bearing plate 62 act together to press the handle back into a horizontal resting position.

Figure 7C:
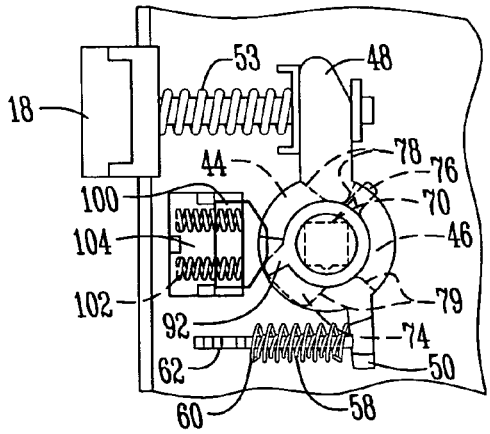

In reverse operation, as seen in FIG. 7C, the user turns the handle counterclockwise moving the cam 70 such that first cam arm 74 travels freely through the first slot 44 and the second cam arm 76 travels through the second slot 46. In this fashion the hub stays stationary so that no action is applied to the live bolt 18. The first arm 74 of the cam 70 strikes a spring point 100 which compresses biasing members 102 to permit the spring face to go into the spring seat 104. When the handle is turned approximately 45°, the first cam arm 74 compresses the spring point 100 into the spring seat 104 but as the first arm 74 travels to an angled portion 101 of the spring point 100 the biasing member 102 pushes the spring point outward to assist the cam 70 to travel to a position where the handle is approximately vertical and held in the vertical position. To return to the normal horizontal position, the user must manually turn the handle 22 clockwise in order to move the first arm 74 from a resting position against the spring point 100. Once the first arm 74 is past the spring face, the angled sides 101 assists the cam 70 to travel to a position where the handle is horizontal.

A preferred embodiment of the present invention has been set forth above. It should be understood by one of ordinary skill in the art that modifications may be made in detail, especially in matters of shape, size and arrangement of parts. Such modifications are deemed to be within the scope of the present invention which is to be limited only by the broad, general meaning of the terms which dependent claims are expressed.

What is claimed is:

1. A storm door with a lift-up handle, the storm door comprising:

a metal door having a frame formed of first and second opposing walls joined by sidewalls;

the frame having an opening;

a lock case intermediate the opposing walls and having an actuator and a live bolt;

the live bolt interacting with the actuator for movement between an extended and retracted position relative one of the sidewalls;

a spindle interacting with the actuator to move the live bolt;

a handle attached to the spindle, the handle having an elongated member that extends over the opening when the handle is in an approximately horizontal position;

the handle moveable between the horizontal position to a downward position to retract the live bolt;

the handle moveable between the horizontal position and an approximately vertical position wherein the elongated member does not obstruct the opening;

an internal cam mechanism which holds the handle stationary in the vertical position;

wherein the actuator includes:

a hub having opposite faces and first and second edges;

the hub having an internal chamber, a spindle receiving cavity, a first slot in the first edge, and a second slot in the second edge;

the first and second slots each defining top and bottom surfaces in the first and second edges, respectively;

the hub having a top arm attached to the live bolt;

the cam mechanism including a cam fitting within the internal chamber;

the cam having a center opening to engage the spindle, a first cam arm fitting into the first slot, and a second cam arm fitting into the second slot;

wherein when the elongated member of the handle extends over the storm door opening in the horizontal position, the first cam arm abuts the first slot top surface and the second cam arm abuts the second slot bottom surface;

wherein when the elongated member is in the downward position, the spindle moves the first cam arm against the first slot top surface and second cam arm against the second slot bottom surface to rotate the hub top arm and retract the live bolt; and wherein when the elongated member is in the vertical position not obstructing the storm door opening, the first cam arm is adjacent the first slot bottom surface and second cam arm is adjacent the second slot top bottom surface.

2. The storm door of claim 1 wherein the handle is biased to the horizontal position when in the downward position.

3. The storm door of claim 1 wherein the handle is moved upward from the horizontal position into the vertical position.

4. The storm door of claim 1 further comprising a bottom arm on the hub and a lower spring that interacts with the bottom arm to bias the handle to the horizontal position.

5. The storm door of claim 1 comprising a spring point to bias the first cam arm to either the first slot top surface or the first slot bottom surface.

6. The storm door of claim 1 wherein the handle does not retract the live bolt when moved to the vertical position.

7. The storm door of claim 1 wherein the handle is pivoted upwardly to the vertical position.

8. The storm door of claim 1 further comprising biasing means to hold the handle in the vertical position.

9. A lift-up lock case for a storm door with a mortise, the lift-up lock case permitting an elongated handle upon the storm door to be moved to not obstruct manipulation of a storm door panel, the lift-up lock case comprising:

first and second spaced apart side plates;

an actuator and a live bolt both positioned between the side plates;

the actuator adapted to move the live bolt between an extended and refracted position;

the actuator having a hub and an internal cam;

the hub having opposite faces and first and second edges;

the hub having an internal chamber, a spindle receiving cavity formed by opposing holes in the hub faces r, a first slot in the first edge, and a second slot in the second edge;

the first and second slots each defining top and bottom surfaces in the first and second edges, respectively;

the hub having a top arm attached to the live bolt and a bottom arm;

a cam fitting within the internal chamber;

the cam having a center opening to engage a spindle attached to the elongated handle, a first cam arm fitting into the first slot, and a second cam arm fitting into the second slot;

wherein when the elongated handle extends over the frame opening in an approximately horizontal position, the first cam arm abuts the first slot top surface and the second cam arm abuts the second slot bottom surface;

wherein when the elongated handle is in a downward position, the spindle engages the cam center opening to press the first cam arm against the first slot top surface and second cam arm against the second slot bottom surface to rotate the hub top arm and refract the live bolt;

wherein when the elongated handle is in a vertical position not obstructing the frame opening, the first cam arm is adjacent the first slot bottom surface and second cam arm adjacent the second slot top surface.

10. The lock case of claim 9 further comprising a lower spring that interacts with the bottom arm to bias the handle to the horizontal position.

* * * * *

UNITED STATES PATENT AND TRADEMARK OFFICE

CERTIFICATE OF CORRECTION

PATENT NO. : 7,350,555 B2
APPLICATION NO. : 10/957269
DATED : April 1, 2008
INVENTOR(S) : Wu Feng Qing It is certified that error appears in the above-identified patent and that said Letters Patent is hereby corrected as shown below:

Col. 6, Claim 9, Line 44:
DELETE after faces "r"

Signed and Sealed this

First Day of July, 2008

JON W. DUDAS
*Director of the United States Patent and Trademark Office*